US005518251A

United States Patent [19]

Liu

[11] Patent Number: 5,518,251

[45] Date of Patent: May 21, 1996

[54] SCORING SYSTEM FOR GUN BATTLE GAMES

[76] Inventor: Pei-Jen Liu, P.O. Box 82-144, Taipei, Taiwan

[21] Appl. No.: 510,499

[22] Filed: Aug. 2, 1995

[51] Int. Cl.[6] ..... F41J 5/04

[52] U.S. Cl. ..... 273/371

[58] Field of Search ..... 273/371, 372

[56] References Cited

U.S. PATENT DOCUMENTS 2,973,964 3/1961 Zito ..... 273/372

5,083,113 1/1992 Slawinski et al. ..... 273/371 X 5,358,253 10/1994 Chen ..... 273/371 X

*Primary Examiner*—William H. Grieb

*Attorney, Agent, or Firm*—Alfred Lei

[57] ABSTRACT

A scoring system for gun battle games, including a plurality of induction targets carried on different parts of the body to convert the signal of the impact of a bullet into a corresponding electrical signal, a control box carried on the body and connected to the induction targets to receive convert the electrical signal from each induction target into a corresponding score, and a display unit carried on the player's cap and connected to the control box to show the total score and to give an alarm signal when the total score reaches a predetermined value.

2 Claims, 3 Drawing Sheets

SCORING SYSTEM FOR GUN BATTLE GAMES

BACKGROUND OF THE INVENTION

1. Field of the Invention

The present invention relates to a scoring system for gun battle games which automatically counts the score of each targeted bullet, and gives an alarm signal when the total score reaches a predetermined value.

2. Description of the Prior Art

Various toy guns have been designed for shooting plastic bullets, and have appeared on the market. These toy guns are commonly used to shoot standing targets, however they are not suitable for a field battle. When safety equipment are prepared, the plastic bullets shot from toy guns do not make hurt to the players. However, when these toy guns are used for a field battle, it is difficult to count the scoring and to decide which side wins the game. Therefore, water guns which are controlled to eject a color liquid are commonly used for field battle games.

SUMMARY OF THE INVENTION

The present invention has been accomplished to provide a scoring system for gun battle games which automatically counts the scoring of the opponent, and gives an alarm signal when the total value of the scoring reaches a predetermined value.

According to the preferred embodiment of the present invention, the scoring system comprises a plurality of induction targets carried on different parts of the body to convert the signal of the impact of a bullet into a corresponding electrical signal, a control box carried on the body and connected to the induction targets to receive convert the electrical signal from each induction target into a corresponding score, and a display unit carried on the player's cap and connected to the control box to show the total score and to give an alarm signal when the total score reaches a predetermined value.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
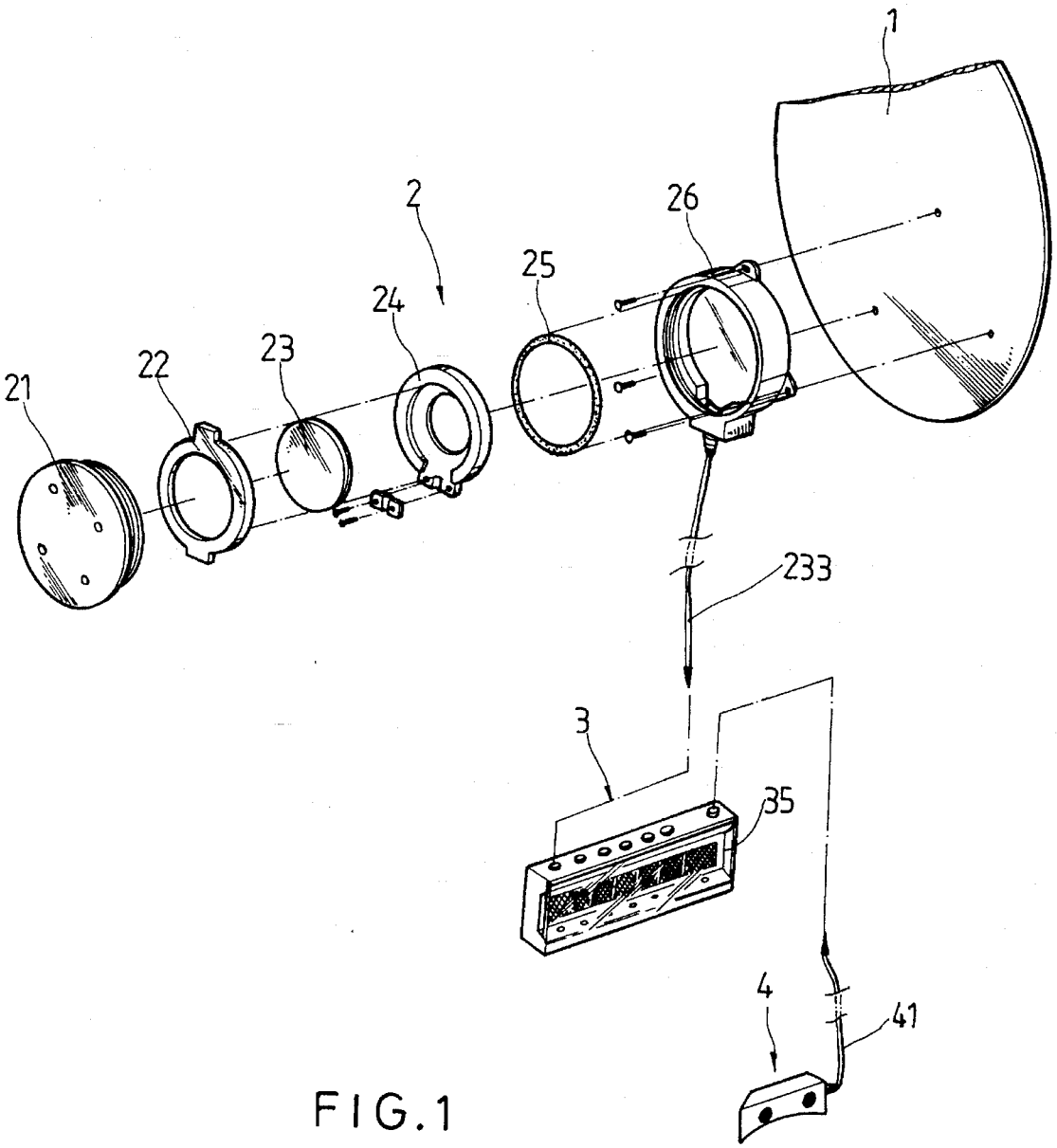
FIG. 1 is an exploded view of an induction target for a scoring system according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
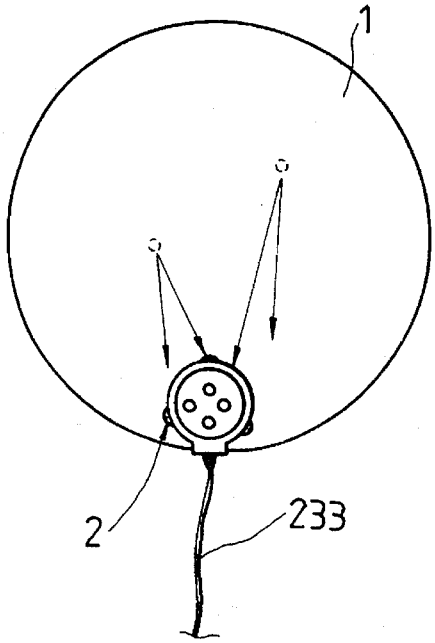
FIG. 2 is a front view of an induction target, showing the sensor mounted on the rigid target plate near the border.

Referring to FIGS. 1 and 2, a scoring system for gun battle games in accordance with the present invention is generally comprised of a plurality of induction targets S1, S2, S3, S4, S5, S6, . . . etc., (see also FIG. 5) each induction target consisting of a rigid target plate 1 and a sensor 2, a control box 3, and a display unit 4. The sensor 2 is detachably fastened to the rigid target plate 1 at one side near the border by screws. The induction target is to be fastened to a part of the body of the player, for example, the back, the abdomen, etc. The induction target can also be fastened to the lining of the player's jacket. However, the installation of the induction target must not hinder the movement of the player. The target plate 1 is a media which receives the signal of the point of impact. When a bullet hits the target plate 1, the signal of the point of impact is transmitted to the sensor 2, which converts the signal of the point of impact (the vibration signal of the target plate 1) into an electrical signal and then sends it to the control box 3 for processing.

Figure 3:
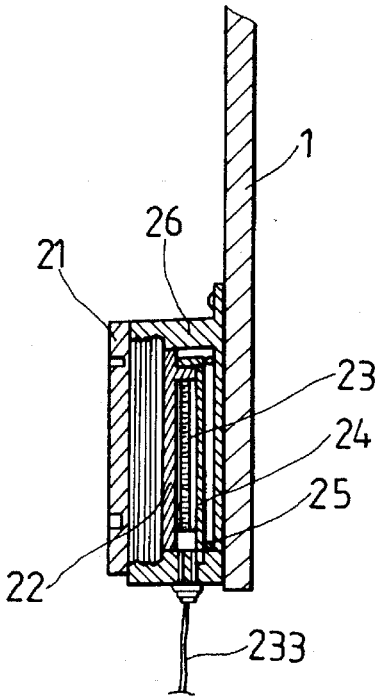
FIG. 3 is a side view in section of an induction target according to the present invention.
Figure 4:
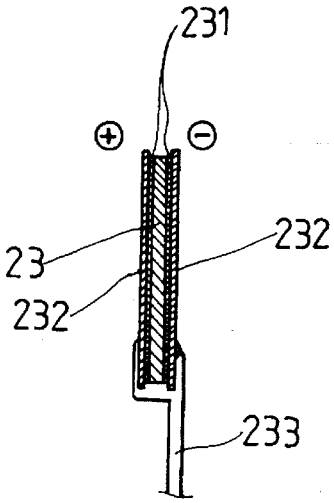
FIG. 4 is a sectional view of a polarized substrate according to the present invention.

Referring to FIGS. 3 and 4, the sensor 2 comprises a casing 26, a rubber ring 25 mounted within the casing 26, a first insulative locating ring 24 supported on the rubber ring 25 inside the casing 26, a second insulative locating ring 22 fastened to the first insulative locating ring 24, a polarized substrate 23 retained inside the casing 26 between the first insulative locating ring 24 and the second insulative locating ring 22, and a cover 21 covered on the casing 26 to hold down the insulative locating rings 22 and 24 inside the casing 26. The sensor 2 is to convert the vibration energy of the point of impact of the bullet into an electrical signal. In order to shorten the reaction time, the substrate of the sensor 2 is polarized and can produce sin waves. Therefore, the substrate is preferably made from polarized ceramics which meet the Newton's law of F=ma. When the voltage V is proportional to the force F, a sin wave is produced. As illustrated in FIG. 4, two copper plates 232 are fastened to two opposite sides of the polarized substrate 23 by a conductive Glue 23, and then connected to the control box 3 by a signal line 233.

Figure 5:
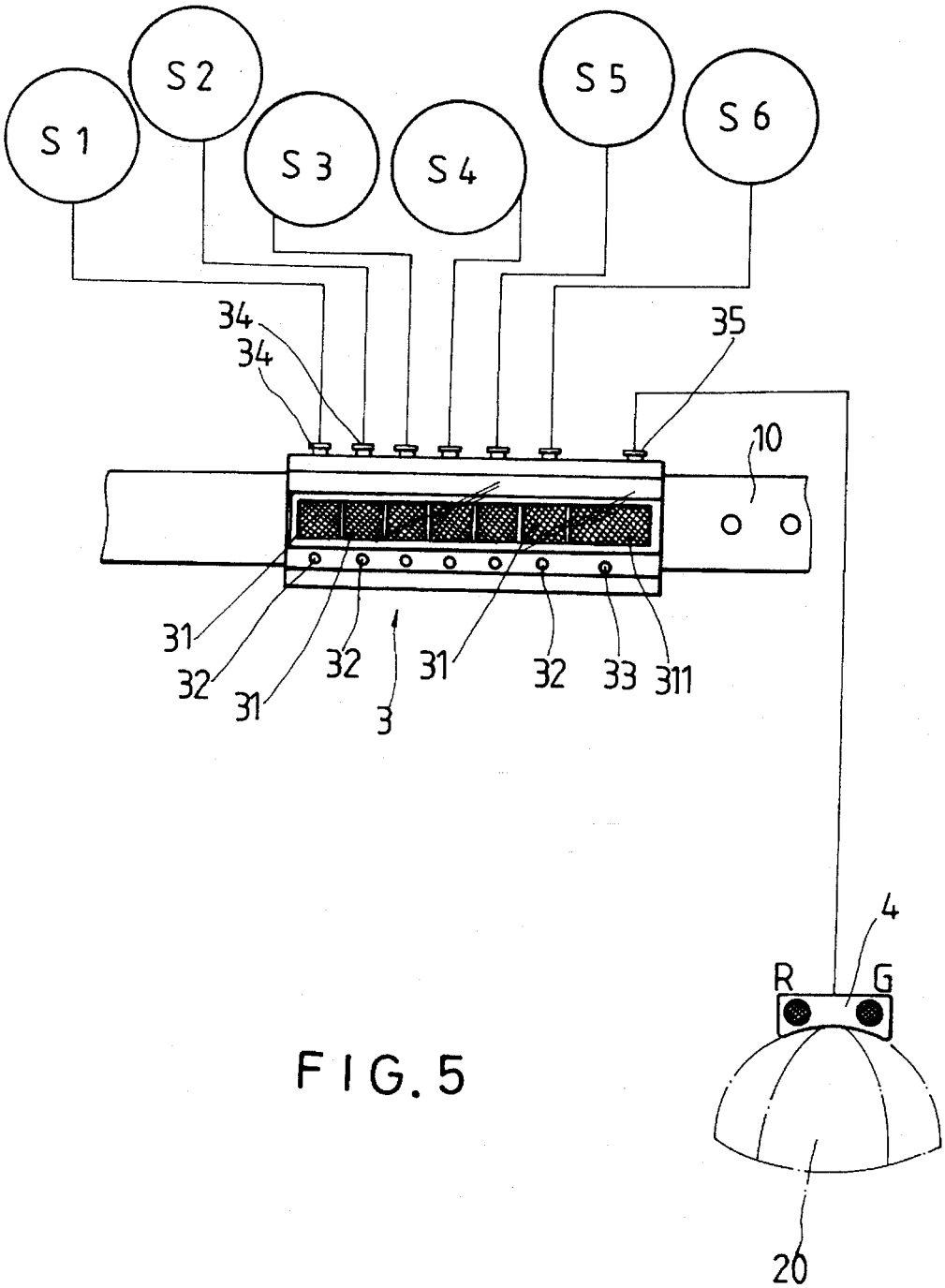
FIG. 5 shows the arrangement of the scoring system according to the present invention.

Referring to FIG. 5, the control box 3 is covered with a transparent covering 35 and mounted on a belt 10 for fastening to the player's arm, waist, etc., comprising a plurality of signal processing units 31 for receiving the signal of the point of impact of the bullet from each induction target, a total score processing unit 311, a plurality of setting keys 32 corresponding to the signal Processing units 31 for setting the score value of the respective induction targets, a plurality of input connectors 34, which receives the signal line 233 of each induction target respectively, an output connector 35, which connects the total score processing unit 311 to the display unit 4, and a clear key 33, which clears all settings.

Referring to FIG. 5 again, the display unit 4 is also carried on the body of the player. Preferably, the display unit 4 is mounted on the player's cap 20. As illustrated in FIGS. 1 and 4, the display unit 4 comprises a signal input line 41 connected to the output connector 35 of the control box 3, a normal indicator lamp G, and an alarm R. When the scoring system works, the normal indicator lamp G gives off light. When the total score reaches a predetermined value, the alarm R (which comprises a flash lamp and an audio alarm device) flashes and gives a warning sound.

The invention is naturally not limited in any sense to the particular features specified in the forgoing or to the details of the particular embodiment which has been chosen in order to illustrate the invention.

Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A scoring system for gun battle games, comprising:

a plurality of induction targets, each induction target comprising a rigid target plate and a sensor mounted on said rigid target plate, said rigid target plate producing a vibration signal upon the hitting of a bullet, said sensor converting said vibration signal into an electrical signal, said sensor comprising a casing, a rubber ring mounted within said casing, a first insulative locating ring supported on said rubber ring inside said casing, a second insulative locating ring fastened to said first insulative locating ring, a polarized substrate retained inside said casing between said first insulative locating ring and said second insulative locating ring, and a cover covered on said casing to hold down said first insulative locating ring and said second insulative locating ring inside said casing, said polarized substrate comprising two copper plates fastened to two opposite sides thereof by a conductive glue, and a signal line connected to said copper plates;

a control box connected to said induction targets to receive the electrical signal from the sensor of each induction target, and to convert the electrical signal from the sensor of each induction target into a corresponding score, said control box comprising a plurality of signal processing units respectively connected to the signal line of the sensor of each induction target for processing the vibration signal from each induction target into a corresponding score, a total score processing unit for calculating the scores from said signal processing units, a plurality of setting keys corresponding to said signal processing units for setting the score value of the respective induction targets, and a clear key, which clears all settings; and a display unit connected to said control box to show the total score from said the total score processing unit of said control box, and to give an audio signal and a visual signal when the total score reaches a predetermined value.

2. The scoring system of claim 1 wherein said the rigid target plates of said induction targets are made of different sizes and shapes for carrying on different parts of the player's body.

* * * * *